US006467594B1

(12) United States Patent
Wu

(10) Patent No.: US 6,467,594 B1
(45) Date of Patent: Oct. 22, 2002

(54) LUGGAGE CASE ATTACHABLE TO A BRIEFCASE (HAND AND SHOULDER BAG)

(76) Inventor: Kuo-Chen Wu, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/849,337

(22) Filed: May 7, 2001

(51) Int. Cl.[7] ..... A45C 13/26; A45C 13/30; A45C 3/00

(52) U.S. Cl. ..... 190/108; 190/115; 190/903; 150/107

(58) Field of Search ..... 190/108, 124, 190/110, 903, 102, 115; 150/107, 110

(56) References Cited

U.S. PATENT DOCUMENTS 4,081,061 A * 3/1978 Tucker ..... 190/108 X
4,436,189 A * 3/1984 Baum ..... 190/108
4,756,394 A * 7/1988 Cohen ..... 190/108 X
4,898,274 A * 2/1990 Stout et al. ..... 190/108 X
5,676,223 A * 10/1997 Cunningham ..... 190/108 X
5,875,876 A * 3/1999 Wang ..... 190/108 X
5,944,155 A * 8/1999 Geary ..... 190/108
6,098,769 A * 8/2000 Yen ..... 190/108
6,213,267 B1 * 4/2001 Miller ..... 190/108

* cited by examiner

*Primary Examiner*—Lee Young
*Assistant Examiner*—Tri M. Mai
(74) *Attorney, Agent, or Firm*—Troxell Law Office PLLC

(57) ABSTRACT

The present invention is a luggage case attachable to a briefcase and includes a luggage case and a briefcase mounted and zippered onto the luggage case by means of the zippers on the peripheries. A lifting handle is disposed on the briefcase. The available space in the luggage case will not be occupied by the briefcase, nor will the user have to carry the briefcase while pushing or dragging the luggage case at the same time. The briefcase can be detached from the luggage case, and the cover body can cover the pocket body.

2 Claims, 5 Drawing Sheets

LUGGAGE CASE ATTACHABLE TO A BRIEFCASE (HAND AND SHOULDER BAG)

BACKGROUND OF THE INVENTION

1) Field of the Invention

The present invention is a luggage case attachable to a briefcase (hand and shoulder bag), a structure preventing the hand and shoulder bag from occupying the original space of the luggage case and integrating the luggage case into one unit.

2) Description of the Prior Art

With the change of today's society, more working people (such as the business people) have to travel around. The conventional travel trunk, as shown in FIG. 1, comprises of a luggage case (100) with determined accommodating space (101); a zipper half (102) is disposed on the opening end rim of the said luggage case (100), furthermore, an inner wall (110) fitting with the shape of the luggage case (100) is mounted on the opening of the said luggage case (100); a net pocket (112) is mounted on the inner side of the said inner wall (110) for storing the objects; a zipper half (111) is disposed on the periphery of the said inner wall (110) for fixing the said inner wall (110) onto the luggage case (100) through the zipping of the zipper halves (102, 111); furthermore, a case cover (120) is mounted on the inner wall (110) of the said luggage case (100); a zipper half (121) is also disposed on the periphery of the said case cover (120) for integrating the luggage case (100) into one unit through the zipping of the zipper halves (111, 121); there is also a accommodating pocket mounted on the surface of the said case cover (120); however, when in use, the case cover (120) of the said luggage case (100) can only be used for covering the luggage case (100) with no other applications; the general travelers, especially those on business trips, will put the necessities for traveling into the travel trunks and the other document or references needed for the business trip will be placed into a hand and shoulder bag (200) in smaller size for easy access and carrying outdoors; however, since the hand and shoulder bag (200) is an independent unit, during the traveling, the user has to carry the hand and shoulder bag (200) with one hand and dragging the luggage case (100) with another hand, so the user has no spare hand for handling other things and that is very inconvenient; in order to let the user have one hand free, the hand and shoulder bag (200) can be stuffed into the luggage case (100), however, the determined space of the luggage case (100) will be occupied thereby to reduce the accommodating space of the luggage case (100) and that is not very ideal in use.

SUMMARY OF THE INVENTION

In view of the mentioned shortcomings of the conventional luggage case, the inventor of the invention addressed the key problems by starting to work for improving those disadvantages and searching for a rational solution, following many researches and designs, finally culminated in the present invention of a luggage case attachable to a briefcase (hand and shoulder bag), a structure preventing the hand and shoulder bag from occupying the available space in the luggage case, integrating the luggage case into one unit and comprising a luggage case for accommodating the objects with the zippers mounted on the said luggage case for zipping it with the hand and shoulder bag mounted with a lifting handle and a shoulder strap thereon.

The objective of the present invention is, through the mentioned structure, to spread the hand and shoulder bag and fix it onto the luggage case by means of the zippers on the peripheries, therefore, not only the available space will not be occupied, nor will the user have to carry the hand and shoulder bag while pushing or dragging the luggage case at the same time; or, the hand and shoulder bag can be detached from the luggage case to make the cover body of the hand and shoulder bag cover on the hand and shoulder bag to thereby convenience the user's carrying the hand and shoulder bag by itself.

For achieving the above objective, the adopted technical method and its effect related to the present invention will be further understood by the brief description of the drawings below followed by the detailed description of the preferred embodiment.

DETAILED DESCRIPTION OF THE PREFERRED EMBODIMENTS

Figure 2:
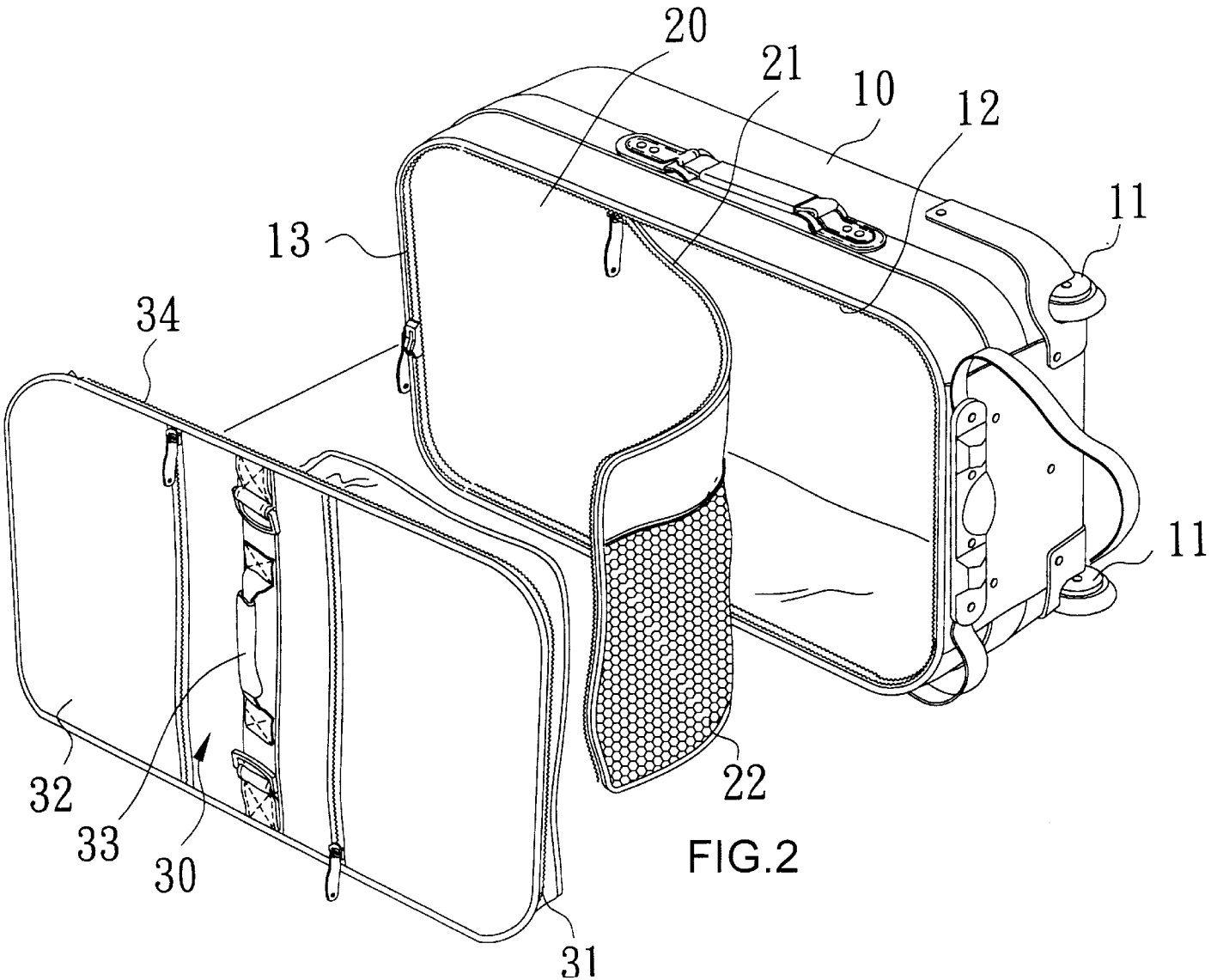
FIG. 2 is an exploded pictorial and schematic drawing of the present invention.
Figure 3:
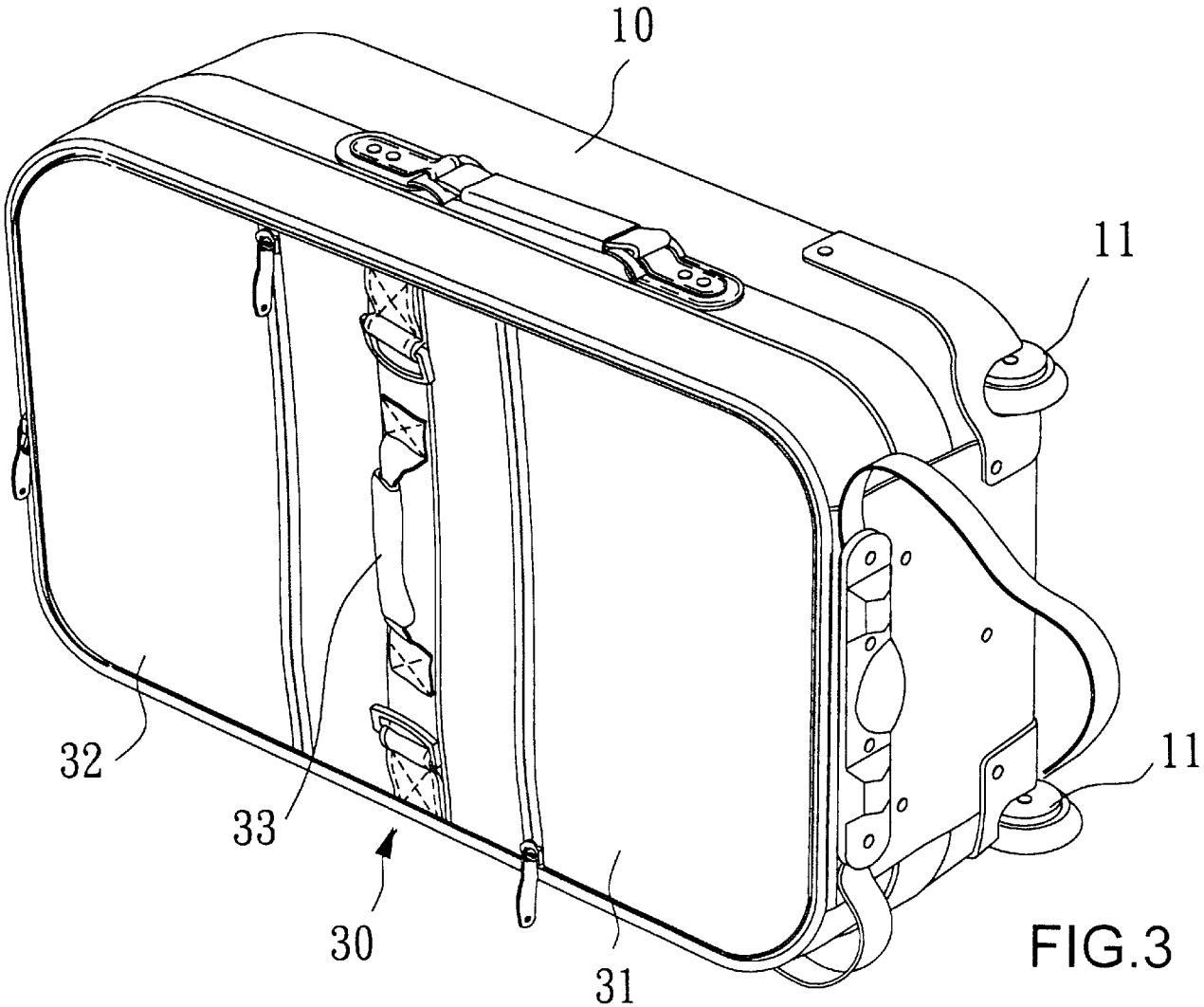
FIG. 3 is a pictorial schematic drawing of the assembled present invention.
Figure 5:
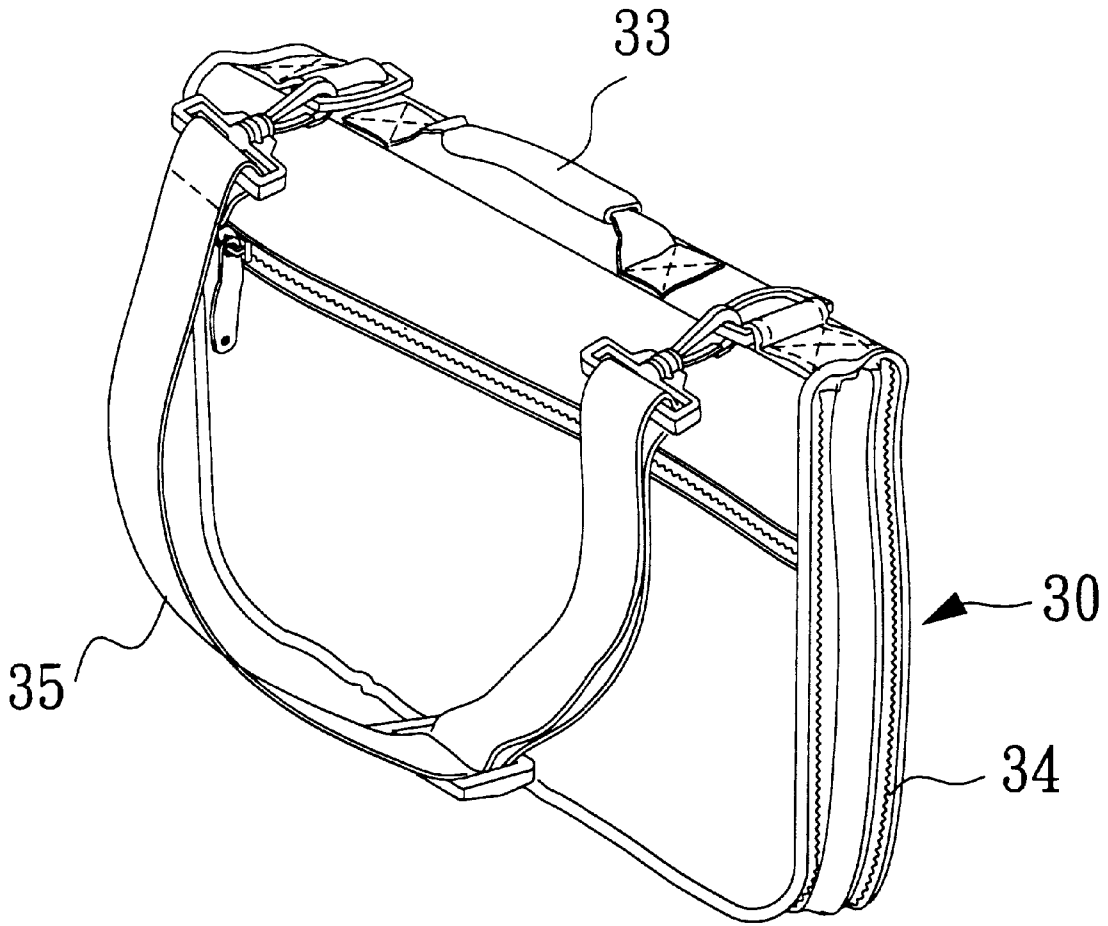
FIG. 5 is a schematic drawing of another embodying movement of the hand and shoulder bag of the present invention.

Referring to FIG. 2, the present invention is a luggage case attachable to a briefcase (hand and shoulder bag), a structure preventing the hand and shoulder bag from occupying the original space of the luggage case and integrating the luggage case into one unit; the said structure is mounted with a luggage case (10) which is a rectangular luggage case (other shapes can be used instead for those skilled in this art) in this exemplary embodiment; the rolling wheels (11) are disposed on one of the end sides of the said luggage case (10) to permit the user to drag the luggage case (10) to move through the rolling of the rolling wheels (11); a zipper half (12) is disposed on the opening end rim of the said luggage case (10), furthermore, an inner wall (20) fitting with the shape of the luggage case (10) is mounted on the opening of the said luggage case (10); a net pocket (22) is mounted on the inner side of the said inner wall (20) for storing the objects; a zipper half (21) is disposed on the periphery of the said inner wall (20) for covering the said inner wall (20) onto the luggage case (10) through the zipping of the zipper halves (12, 21); furthermore, a spread hand and shoulder bag (30) is zippered on the inner wall (20) of the said luggage case (10); a pocket body (31) is mounted on the said hand and shoulder bag (30), the said pocket body (31) can be designed into different styles according to the needs; a cover body (32) is disposed on and designed to connect with the pocket body (31) of the said hand and shoulder bag (30) into one unit; the area of the cover body (32) is the same as that of the pocket body (31); furthermore, a lifting handle (33) is mounted on the surface of the said hand and shoulder bag (30) for carrying; a hand carrying and shoulder strap (35) is disposed on the surface of the hand and shoulder bag (30) for the user to shoulder (as shown in FIG. 5); the said hand and shoulder bag (30) is situated between the pocket body (31) and the cover body (32); furthermore, a zipper half (34) is mounted along the peripheries of the pocket body (31) and the cover body (32) of the said hand and shoulder bag (30); the said zipper half (34) can be zippered with the zipper half (13) of the luggage case (10) to make the hand and shoulder bag (30) attach onto the luggage case (10) without occupying the original storage space of the luggage case (10) (as shown in FIG. 3).

Figure 1:
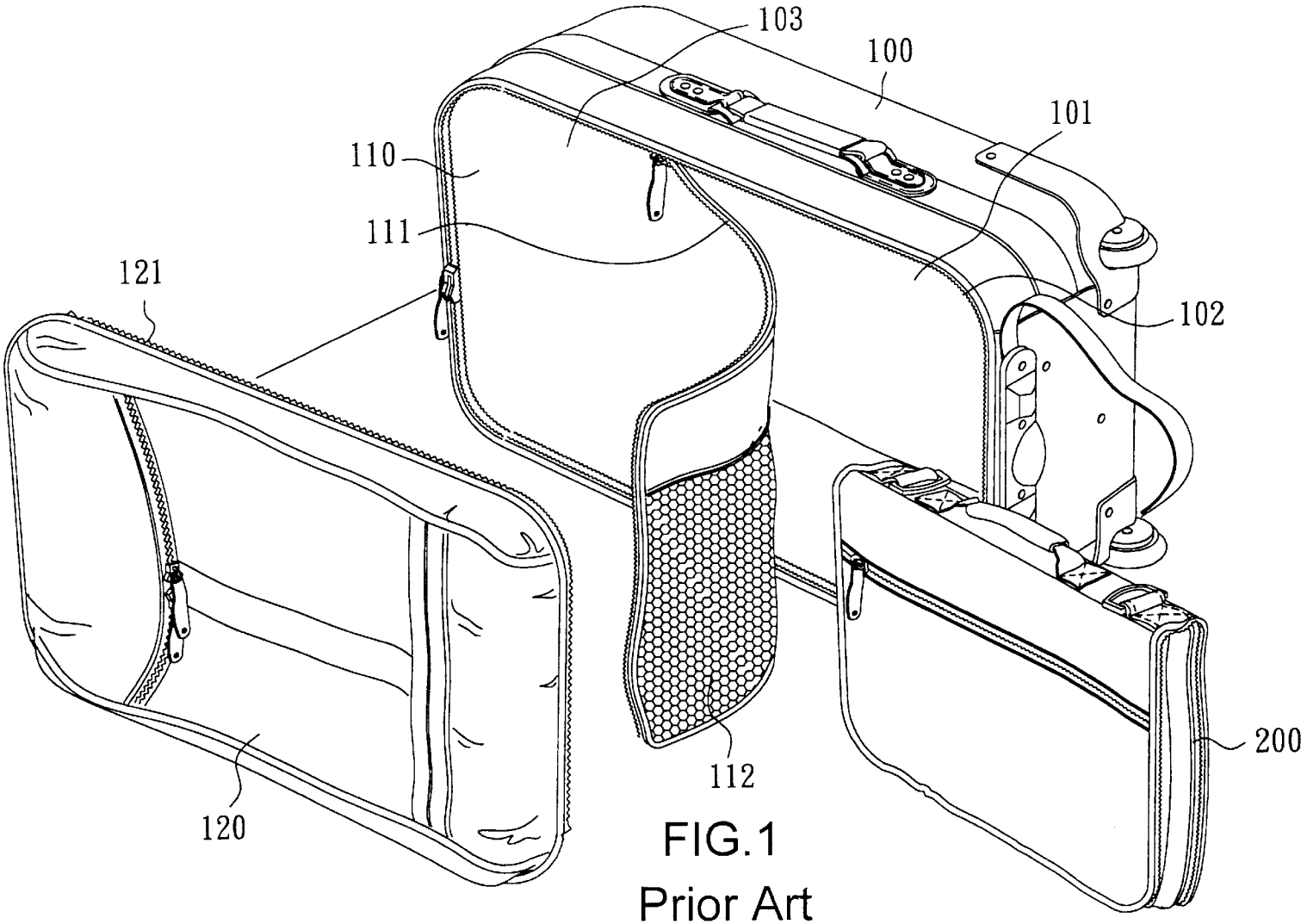
FIG.1 Prior Art
FIG. 1 is a schematic drawing of the conventional luggage case and the hand and shoulder bag.
Figure 4:
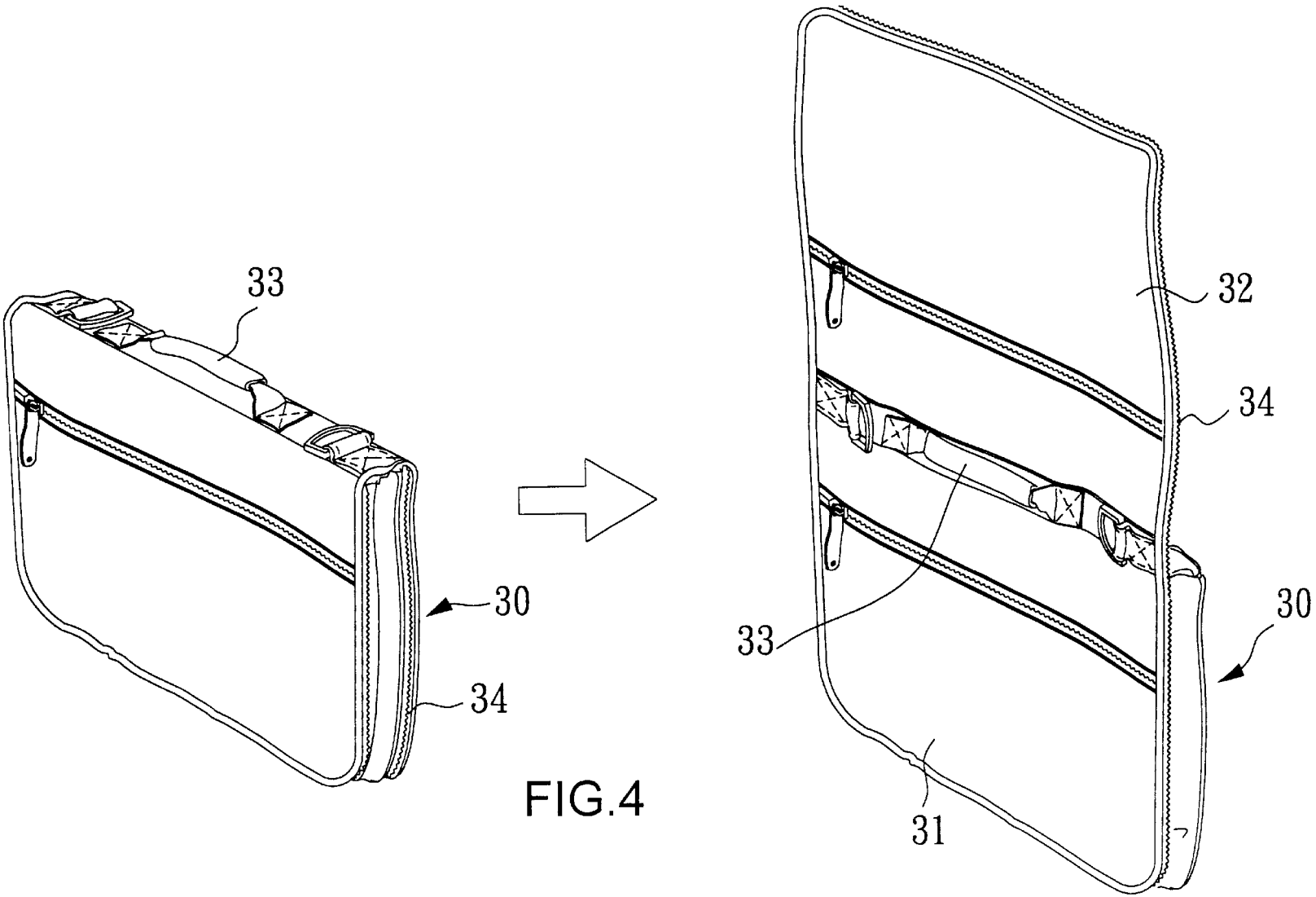
FIG. 4 is a schematic drawing of the embodying movement of the hand and shoulder bag of the present invention.

Referring to FIG. 4, when the user wants to use the hand and shoulder bag (30) by itself, he can detach the spread hand and shoulder bag (30) attached on the luggage case (10) from the luggage case (10), that means to separate the zipper half (34) on the hand and shoulder bag (30) from the zipper half (13) on the luggage case (10) to make the hand and shoulder bag (30) an independent unit, and at the same time, seal the inner wall (20) onto the luggage case (10) and cover the cover body (34) onto the pocket body (31) thereby to form a hand and shoulder bag (30) for the user to carry or shoulder; furthermore, in addition to being used with the hand and shoulder bag (30) of the present invention, the said luggage case (10) can also be used with the conventional case cover (120) (as shown in FIG. 1).

In summation of the foregoing sections, the present invention is innovative in terms of the shapes, structures and devices of the objects, capable of improving all the shortcomings of the conventional technique and increasing the efficiency of usage, is feasible, fully complies with all new patent application and is truly an ideal invention.

What is claimed is:

1. Luggage with a detachable briefcase and comprising:

a) a luggage case having an opening side with a first zipper half disposed on the luggage case around the opening side;

b) an inner wall removably connected to the opening side of the luggage case by engagement of a second zipper half on the inner wall with the first zipper half, the inner wall having a third zipper half; and, c) a briefcase removably attached to the inner wall, the briefcase including a pocket body, a cover body on the pocket body, an area of the cover body being the same as an area of the pocket body, and a lifting handle mounted on an outer surface of the briefcase, edges of the pocket body and cover body forming a periphery of the briefcase, and a fourth zipper half on the periphery of the briefcase removably engaged with the third zipper half on the inner wall, whereby when the briefcase is attached to the inner wall the outer surface and lifting handle face away from the luggage case, and when the briefcase is detached from the inner wall, the engagement of the fourth zipper half on the pocket body and cover body connects the pocket body and cover body together such that the cover body covers one side of the pocket body.

2. The luggage case of claim 1 further comprising a shoulder strap removably connected to the briefcase.

* * * * *